United States Patent [19]

Maeda

[11] 4,077,221

[45] Mar. 7, 1978

[54] EXTERNAL HEAT ENGINE

[75] Inventor: Riichi Maeda, Yokohama, Japan

[73] Assignee: Nissan Motor Company, Limited, Japan

[21] Appl. No.: 707,936

[22] Filed: Jul. 23, 1976

[30] Foreign Application Priority Data

Jul. 25, 1975 Japan ..... 50-90191

[51] Int. Cl.[2] ..... F02G 1/04

[52] U.S. Cl. ..... 60/650; 60/517; 60/524; 60/682

[58] Field of Search ..... 60/517, 518, 519, 520, 60/521, 522, 650, 682

[56] References Cited

U.S. PATENT DOCUMENTS

| | | | |
|---|---|---|---|
| 1,128,834 | 2/1915 | Aspinall | 60/650 |
| 1,926,463 | 9/1933 | Stoddard | 60/682 |
| 3,426,525 | 2/1969 | Rubin | 60/519 |

FOREIGN PATENT DOCUMENTS

| | | | |
|---|---|---|---|
| 368,439 | 10/1906 | France | 60/682 |
| 177,142 | 11/1906 | Germany | 60/517 |
| 446,768 | 11/1934 | United Kingdom | 60/682 |

*Primary Examiner*—Allen M. Ostrager
*Attorney, Agent, or Firm*—Balogh, Osann, Kramer, Dvorak, Genova & Traub

[57] ABSTRACT

A heat engine having a cold compression space, a hot expansion space, a first passage connecting the two spaces through an externally heated heater and a second passage connecting the two spaces independently of the first passage through an externally cooled cooler. Preferably with the provision of intake and discharge valves, the two passages are arranged such that a working gas confined in the engine is passed from the compression space to the expansion space through the first passage and then returned to the compression space through the second passage. The engine may be combined with a gas reservoir which is equipped with valves and connected to the passages at low temperature sections for controlling the engine power by varying the mass of the working gas confined in the engine.

8 Claims, 10 Drawing Figures

EXTERNAL HEAT ENGINE

This invention relates to a heat engine having a variable volume cold compression space and a variable volume hot expansion space, which are coupled to allow a working gas to go back and forth therebetween through heat exchangers arranged to supply heat to the compressed working gas from an external heat source and absorb heat from the expanded working gas.

The Stirling engine, which runs on external heat, is known as a possible alternative to internal combustion engines. This invention has a close connection with the Stirling engine, so that a brief description of the principle of the Stirling engine will first be presented.

In the accompanying drawings

Figure 2:
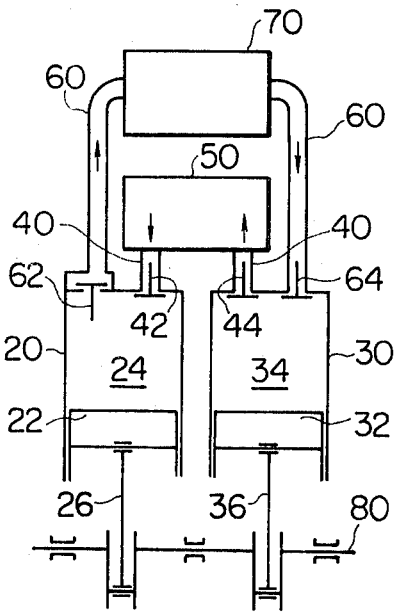
FIG. 2 is a diagrammatic presentation of a heat engine as a preferred embodiment of the invention.
Figure 4:
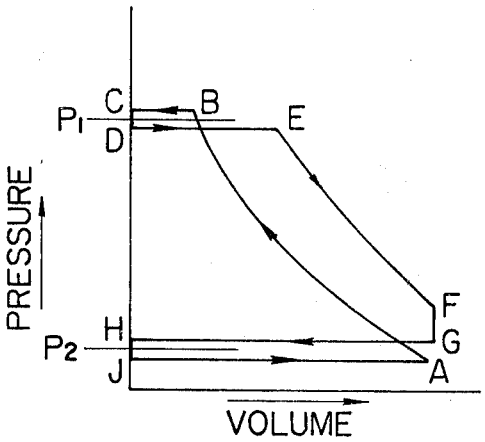
Figure 3A:
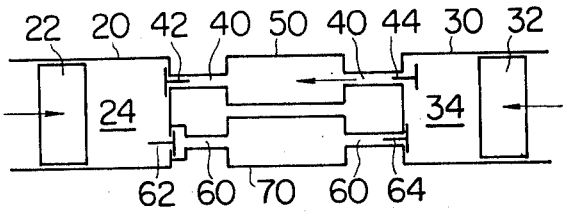
Figure 3B:
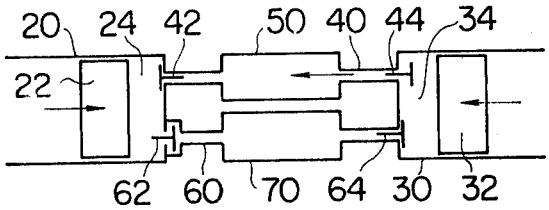
Figure 3C:
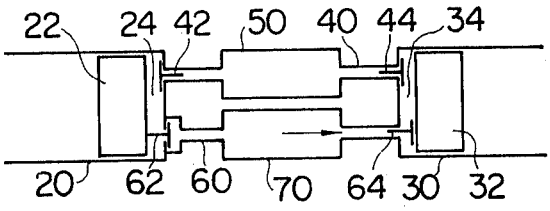
Figure 3D:
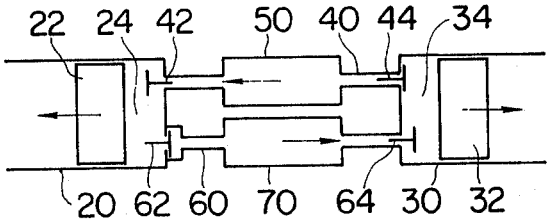
Figure 3E:
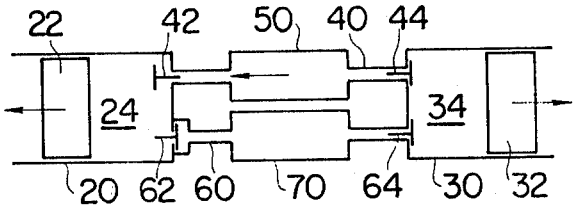
Figure 3F:
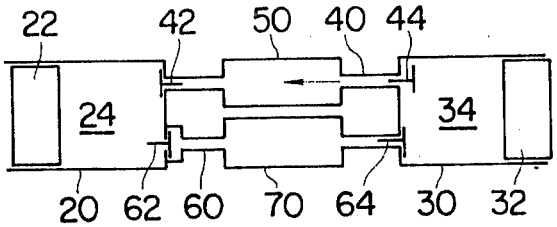
Figure 5:
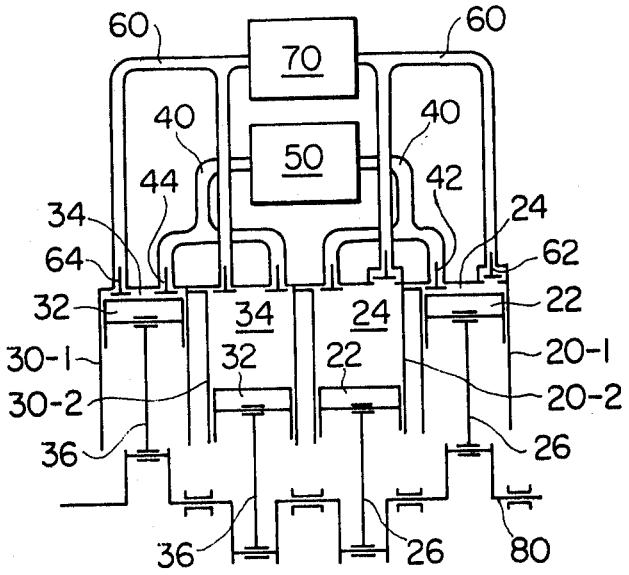
Figure 6:
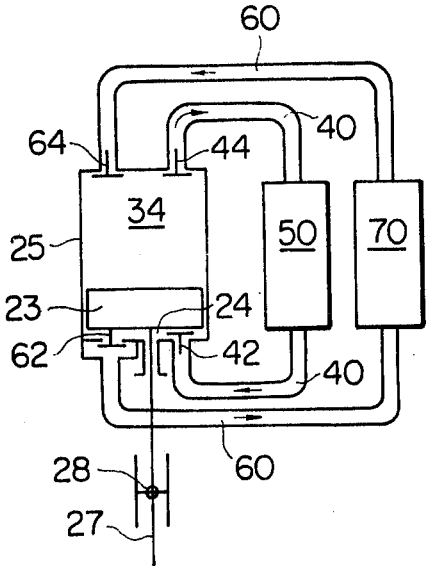
Figure 7:
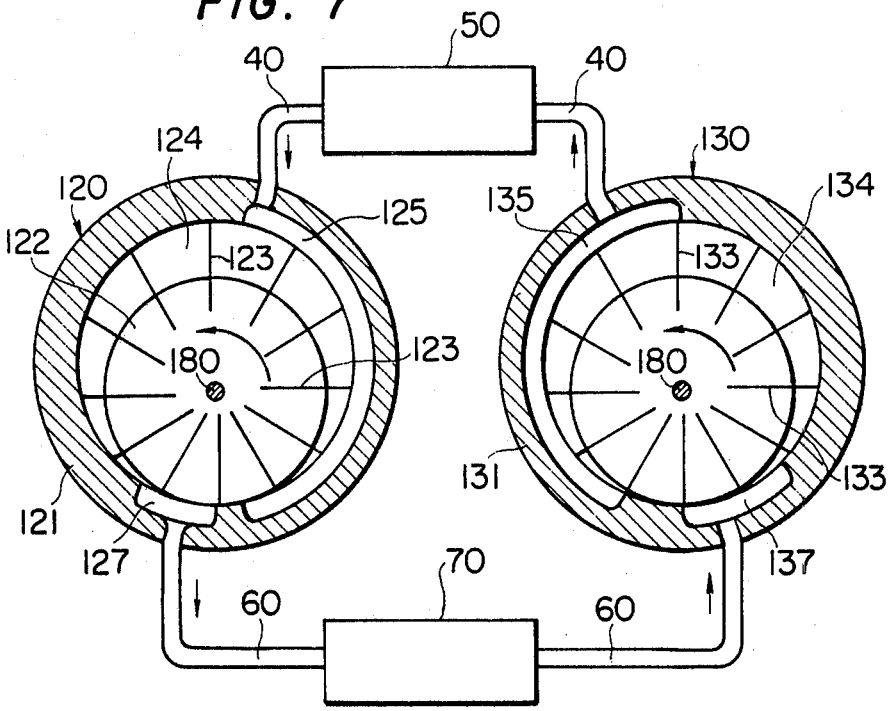
Figure 8:
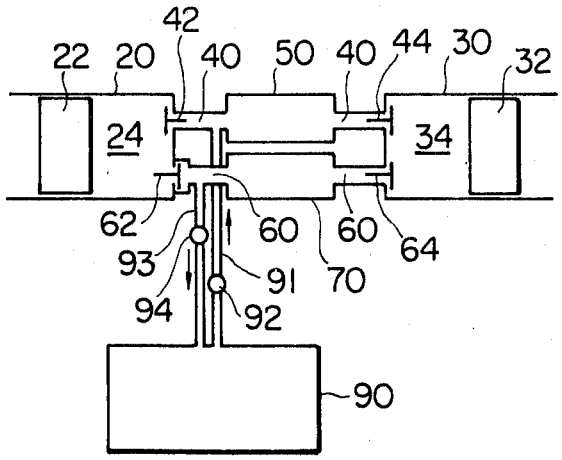
Figure 9:
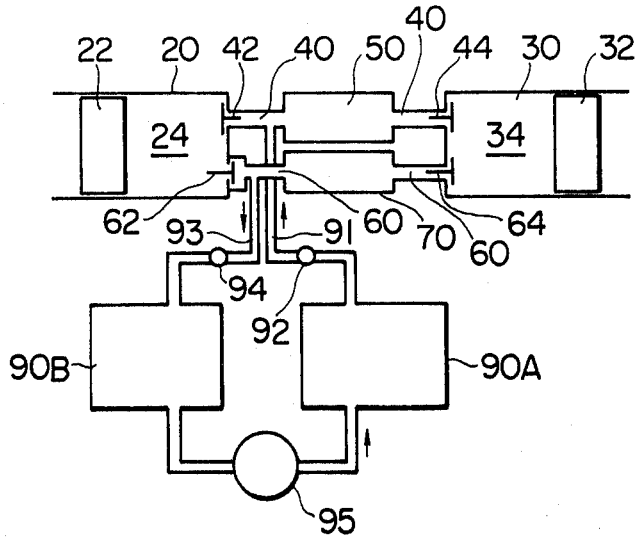
Figure 10:
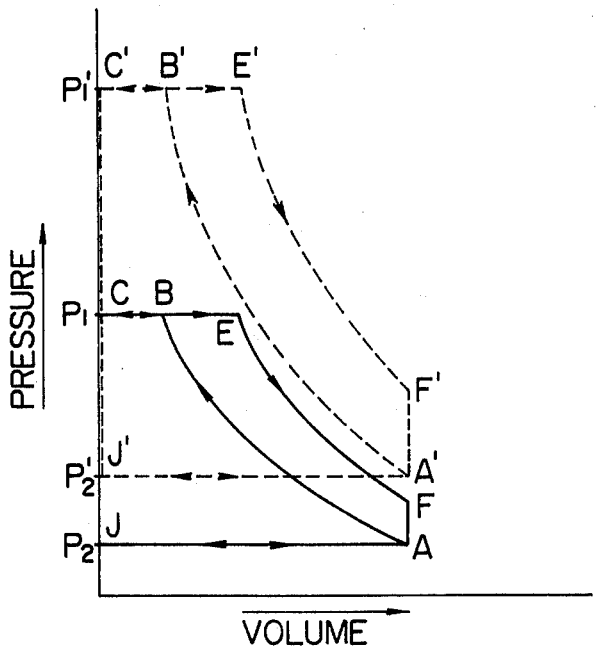

FIGS. 3*a*–3*f* are a series of diagrammatic views of an essential part of the heat engine of FIG. 2 to show a full cycle of operation of the engine;

FIG. 4 is a pressure-volume diagram for a cycle of operation of the engine of FIG. 2;

FIG. 5 shows a heat engine which is fundamentally similar to the engine of FIG. 2 but has the compression and expansion spaces in larger numbers;

FIGS. 6 and 7 show two differently constructed heat engines, respectively, also as preferred embodiments of the invention;

FIG. 8 shows a combination of the engine of FIG. 2 and apparatus for controlling the power of the engine;

FIG. 9 is generally similar to FIG. 8 except for a slight modification of the control apparatus; and FIG. 10 is a pressure-volume diagram for the explanation of the function of the control apparatus of FIGS. 8 and 9.

The Stirling engine has two spaces which are coupled through a heater, a regenerator and a cooler. The volumes of the two spaces are varied cyclically so that a working gas, for example air, confined in the engine undergoes the repetition of a cycle of compression in one space and expansion in the other space. The temperature during operation in the compression space is low and it is high in the expansion space.

Figure 1:
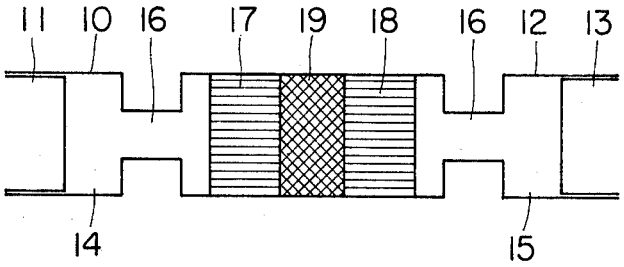
FIG. 1 is a diagrammatic presentation of the fundamental construction of the Stirling engine.

In an exemplary Stirling engine of FIG. 1, a cylinder 10 receiving therein a reciprocating piston 11 and another cylinder 12 receiving therein a piston 13 respectively provide a compression space 14 and an expansion space 15. A passage 16 provides fluid communication between the compression space 14 and the expansion space 15. A cooler 17 and a heater 18 constitute part of the passage 16 in such an arrangement that the cooler 17 is interposed between the compression space 14 and the heater 18, and a regenerator 19 is confined in the passage 16 to occupy a section between the cooler 17 and the heater 18. No valve is provided to the passage 16, so that the passage serves alternately as part of the compression space 14 and as part of the expansion space 15. The heater 18 is a heat exchanger to transfer heat from an external heat source to the working gas passing through the passage 16. The cooler 17 also is a heat exchanger to extract heat from the working gas by the use of an external cooling medium. The regenerator 19 allows the working gas to pass therethrough and is regarded as a heat reservoir, alternately accepting and releasing heat. The compression piston 11 and the expansion piston 13 are connected to a crankshaft (not shown) individually with a connecting rod (not shown) to move with a phase difference from one another by a certain crank angle.

The working gas is compressed in the compression cylinder 10 and the passage 16 while the expansion piston 13 is at its inner dead center. The compressed gas absorbs heat in the heater 18 and causes the expansion piston 13 to move to its outer dead center. Power is gained from the engine at this stage through the crankshaft. Then the expansion piston 13 moves to reduce the volume of the expansion space 15 and the compression piston 11 moves to increase the volume of the compression space 14. Accordingly the expanded gas returns to the compression space 14 via the heater 18, the regenerator 19 and the cooler 17. The regenerator 19 absorbs heat from the expanded gas which is at a high temperature and stores the absorbed heat. The working gas is further cooled in the cooler 17 before entering the compression cylinder 10. The heat stored in the regenerator 19 is utilized to preheat the working gas when the gas is forced to pass through the passage 16 towards the expansion cylinder 12 in the next cycle of the operation.

In this engine, the working gas goes back and forth between the compression cylinder 10 and the expansion cylinder 12 through the same passage 16 which includes the heat exchangers 17, 18, 19 in a fixed arrangement. A disadvantage of this engine, originating in the shuttle movement of the working gas through the same passage 16, is that neither the heating nor cooling of the working gas is accomplished at a high efficiency. For example, the working gas must be cooled when it is passed from the expansion cylinder 12 into the compression cylinder 10. Nevertheless, the expanded working gas must pass through the heater 18 before passing through the cooler 17. In addition, a portion of the passage 16 remains at a high temperature when the working gas is discharged from the expansion cylinder 12 due to the preceding passing of the heated working gas. The periodical reverse turns of the working gas in the passage 16 further contribute to the lowering of the thermal efficiency by causing the stagnation of a portion of the working gas in the passage 16.

The provision of no valves to the passage 16 also is unfavorable to the efficiency of the engine. The working gas is subjected to compression and expansion not only in the compression cylinder 10 and the expansion cylinder 12, respectively, but also in the passage 16. In other words, both the compression space 14 and the expansion space 15 include a considerably large and almost futile space. As the result, this engine is operated only at low compression and expansion ratios.

It is an object of the present invention to provide a heat engine which works on a closed cycle of a working gas by the support of an external heat as in the Stirling engine but features an improved thermal efficiency.

It is another object of the invention to provide an external heat engine which has a high thermal efficiency and the ability of producing a variable power without causing a significant variation in the thermal efficiency.

An essential feature of the invention resides in that the compression space and expansion space of a heat engine of the Stirling engine type are connected by two independent passages in order to pass the compressed working gas to the expansion space only through a first passage which is provided with a heater and return the expanded working gas to the compression space only through a second passage which is provided with a cooler.

According to the invention, an external heat engine comprises the following elements: (*a*) a gas compression apparatus having a movable member arranged to define a variable volume compression space; (*b*) a gas expansion apparatus having a movable member arranged to define a variable volume expansion space; (*c*) a driving mechanism arranged to be driven by the movement of the movable member of the expansion apparatus and drive the movable member of the compression apparatus; (*d*) a first fluid passage connecting the compression space to the expansion space; (*e*) a first heat exchanger arranged to transfer heat from an external heat source to a working gas confined in the engine at a section of the first passage; (*f*) a second fluid passage connecting the expansion space to the compression space independently of the first passage; (*g*) a second heat exchanger arranged to absorb heat from the working gas at a section of the second passage; wherein the first and second passages are arranged such that the working gas is passed from the compression space to the expansion space only through the first passage and is returned to the compression space only through the second passage.

The engine preferably has intake and discharge valves to govern the communication of the compression space with the second passage and with the first passage, respectively, and another set of intake and discharge valves to govern the communication of the expansion space with the first passage and with the second passage, respectively.

The compression apparatus and expansion apparatus may be either of the reciprocating piston type or of the rotary type. In any case, it is possible to construct an engine having two or more sets of the combination of the compression apparatus and expansion apparatus without necessarily using an increased number of heat exchangers.

An external heat engine according to the invention can be combined with an engine power control apparatus, which comprises a gas reservoir that contains therein the working gas in a pressurized state and is connected to the first and second passages of the engine at sections where the working gas is at relatively low temperatures and valves to govern the communication of the reservoir with the engine. The engine power can be augmented by supplying the working gas to the engine and lessened by extracting a portion of the working gas from the engine.

Other features and advantages of the invention will become apparant from the following detailed description of preferred embodiments.

FIG. 2 shows a heat engine as an embodiment of the invention in the simplest form. In this engine, a cold compression cylinder 20 receiving therein a reciprocating piston 22 to define a variable volume compression space 24 and a hot expansion cylinder 30 receiving therein a reciprocating piston 32 to define an expansion space 34 are arranged in parallel with one another. The two pistons 22 and 32 are connected to a crankshaft 80 of the engine with two connecting rods 26 and 36, respectively. A fluid passage 40 connects the compression space 24 to the expansion space 34 through a cooler 50 which is a heat exchanger based on an external cooling medium. This engine includes another fluid passage 60 which is independent from the passage 40 but also connects the compression space 24 to the expansion space 34 through a heater 70 or heat exchanger combined with an external source of heat. The passage 40 provided with the cooler 50 is intended to be of use only for passing a working gas (which is confined in the engine as in the Stirling engine) from the hot expansion cylinder 30 to the cold compression cylinder 20. Accordingly, an intake valve 42 is arranged to govern the communication of the compression space 24 with the passage 40 and a discharge valve 44 is arranged to govern the communication of the expansion space 34 with the passage 40. The purpose of the passage 60 provided with the heater 70 is for passing the working gas from the cold compression cylinder 20 to the hot expansion cylinder 30. An intake valve 64 and a discharge valve 62 are arranged to govern the communication of the passage 60 with the expansion space 34 and the compression space 24, respectively. These valves 42, 44, 62 and 64 are respectively provided with valve-actuating mechanisms (not shown) which may be associated with the crankshaft similarly to valve trains in internal combustion engines.

The cold compression cylinder 20 receiving therein the reciprocating piston 22 will hereinafter be referred to as the compressor 20, because it is presented as an example of apparatus that confines a volume of gas within a closed space in which the pressure of the gas is increased as the volume of the closed space is decreased. This cylinder or compressor 20 has been defined as "cold" because always a precooled working gas is introduced into this compressor 20 as will hereinafter be described. The hot expansion cylinder 30 receiving therein the reciprocating piston 22 will hereinafter be referred to as the expander 30, because it is an example of apparatus that confines a volume of gas within a closed space in which the pressure of the gas is decreased as the volume of the closed space is increased. This cylinder or expander 30 has been defined as "hot" because always a preheated working gas is introduced into this expander 30.

A full cycle of the operation of this engine will be described with reference to FIG. 3. The view (*a*) of FIG. 3 shows an early stage of a compression stroke in the compressor 20. At this stage, both the intake and discharge valves 42 and 62 for the compressor 20 are kept closed. The intake valve 64 for the expander 30 is also closed, but the discharge valve 44 is in the open state. The piston 32 of the expander 30 is moving to decrease the volume of the expansion space 34, so that a portion of the working gas is being transferred to the cooler 50.

The view (*b*) shows a later stage of the same compression stroke. The piston 22 is now close to its inner (or top) dead center, and the gas pressure in the compression space 24 is distinctly above the gas pressure in the heater 70. At this stage, the discharge valve 62 for the compressor 20 opens either automatically in response to the pressure difference between the compression space 24 and the passage 60 or by means of a mechanical valve-actuator, so that the compressed gas begins to enter the heater 70. In the expander 30, the piston 32 still continues to discharge the working gas to the cooler 50.

At the stage (*c*), the compression piston 22 is in its inner dead center and at the same time the expansion piston 32 is in its inner dead center. The discharge valves 62 and 44 are closed at this stage. The intake valve 42 for the compressor 20 is still kept closed, but the intake valve 64 for the expander 30 is opened at this stage by means of a mechanical valve-actuator.

After that, the pistons 22 and 32 move to increase the volumes of the compression space 24 and the expansion space 34, respectively, as shown at (*d*). At the same time, the intake valve 42 for the compressor 20 opens in response to the pressure difference between the passage 40 and the compression space 24 to receive the cooled working gas from the cooler 50. The discharge valve 44 and the intake valve 64 for the expander 30 remain in the closed and open states, respectively, so that the expansion space 34 continues its intake of the working gas which is in a high-temperature and high-pressure state.

Then the intake valve 64 for the expansion space 34 is closed as shown at (*e*) and the working gas is expanded in the expander 30 as the piston 32 approaches its outer dead center. This engine provides power on this stroke of the expansion piston 32. The piston 22 of the compressor 20 also approaches its outer dead center to complete intake of the working gas from the cooler 50.

The two pistons 22 and 32 simultaneously reach their outer dead center as shown at (*f*). The two valves 42 and 62 for the compressor 20 and the intake valve 64 for the expander 30 are in the closed state at this stage, but the discharge valve 44 is opened at this stage, allowing the expanded working gas to enter the passage 40.

Thereafter the pistons 22 and 32 again move as shown at (*a*). In this engine, a fraction of the power produced by the expander 30 is utilized to drive the piston 22 of the compressor 20.

The diagram of FIG. 4 shows the relationship between the volume and pressure of the working gas during the above described cycle of the operation. The pressures $P_1$ and $P_2$ on the ordinate represent the pressure of the working gas in the heater 70 and that in the cooler 50, respectively, assuming that both $P_1$ and $P_2$ are constant.

In this diagram, the path AB indicates the compression of the working gas in the compressor 20. The discharge valve 62 for the compressor 20 opens at B (view (*b*) of FIG. 3), and the path BC represents the discharge of the working gas from the compressor 20 to the heater 70. The pressure difference between C and D is attributable to the resistance offered to the working gas by the heater 70. The path DE indicates the transfer of the working gas from the heater 70 to the expander 30. The intake valve 64 for the expander 30 is closed at E (view (*e*) of FIG. 3), and the subsequent expansion of the working gas in the expander 30 is represented by the path EF. At F, the expansion piston 32 reaches its outer dead center, and the discharge valve 44 for the expander is opened (view (*f*) of FIG. 3). The communication of the expansion space 34 with the passage 40 results in the pressure decrease from F to G. The path GH represents the inward movement of the expansion piston 32 to discharge the working gas from the expander 30 to the cooler 50 (view (*a*) of FIG. 3). The pressure drop from H to J corresponds to the resistance offered to the working gas by the cooler 50. The path JA represents the transfer of the working gas from the cooler 50 to the compressor 20 (views (*d*) and (*e*) of FIG. 3), and the compression piston 22 reaches its outer dead center at A (view (*f*) of FIG. 3).

A heat engine according to the invention can take the form of a multi-cylinder engine. In the embodiment of FIG. 5, two compressors 20-1, 20-2 and two expanders 30-1, 30-2 are arranged parallel similarly to the cylinders of the in-line four-cylinder internal combustion engine. Two sets of the combination of the compressor 20 and expander 30 in FIG. 2 substantially constitute the engine of FIG. 5. The compressor 20-1 is combined with the expander 30-1 alone while the other compressor 20-2 only with the expander 30-2. It is permissible but not necessary to provide two heaters and two coolers to this engine. It is more convenient to arrange the fluid passages 40 and 60 as illustrated so that both the combination of the compressor 20-1 and expander 30-1 and the other combination of the compressor 20-2 and expander 30-2 can utilize the same heater 70 and cooler 50.

FIG. 6 shows a different modification of the engine of FIG. 2. This engine has a double-acting cylinder 25 which serves simultaneously as a compressor and as an expander. A double-acting piston 23 received in the cylinder 25 defines the compression space 24 on one side thereof and the expansion space 34 on the other side. A crosshead 28 and the connecting rod 27 connect the piston 23 to a crankshaft (not shown).

The compressor and expander in a heat engine according to the invention may be either of the reciprocating type or of the rotating type so long as they are of the positive-displacement type. In FIG. 7, a sliding-vane rotary compressor 120 is combined with a rotary expander 130 of the same type. As is known, the sliding-vane rotary compressor 120 has a generally cylindrical housing 121, a rotor 122 fixedly mounted on a shaft 180 eccentrically in the housing 121 and vanes 123 received in radial slots of the rotor 122. A cross-sectionally crescent-shaped space is defined in the housing around a major portion of the rotor 122. In operation, the centrifugal force created by the rotation of the rotor 122 causes the vanes 123 partly to protrude from the slots and come into contact with the inner wall face of the housing 121. Accordingly, the crescent-shaped space is divided into a plurality of sections 124 each defined between the adjacent two vanes 123. These sections 124 serve as the compression space (24) in the engine of FIG. 7. The volume of each of these sections 124 varies depending on the distance between the rotor 122 and the inner wall face of the housing 121. An inlet port 125 of this compressor 120 is located such that each of these spaces 124 communicates with the inlet port 125 while the volume of each space 124 continues to increase to the maximum. A discharge port 127 is formed at a location where each space 124 has the smallest volume.

The rotary expander 130 is constructed almost identically with the sliding-vane rotary compressor 120: it has a generally cylindrical housing 131, a rotor 132 which is fixedly mounted on the shaft 180 common to the rotor 122 of the compressor 120, and sliding vanes 133 to divide a cross-sectionary crescent-shaped space into a plurality of sections 134 (which serve as the expansion space of this engine). An inlet port 137 of the expander 130 is formed at a location where each section 134 has the smallest volume, and a discharge port 135 is formed such that each section 134 communicates with the discharge port 135 in the maximum volume state.

The fluid passage 40 connects the discharge port 135 of the expander 130 to the inlet port 125 of the compressor 120 through the cooler 50. The passage 70 connects the discharge port 127 of the compressor 120 to the inlet port 137 of the expander 130 through the heater 70.

The working gas is trapped in each of the spaces 134 of the expander 130 when passed from the heater 70 in a heated and pressurized state. The trapped gas undergoes expansion in each space 134 and drives the rotor 132. After expansion, the working gas is cooled by the cooler 50 and introduced into the compressor 120. The rotor 122 of the compressor 120 is driven by a fraction of the power produced by the expansion of the working gas in the expander 130, so that the cooled working gas is compressed in each of the sections 124. Then the compressed gas is discharged through the port 127 to the heater 70. The net output of the engine is defined by the difference between the output of the expander 130 and the input of the compressor 120. The available power of this engine is delivered through the rotating shaft 180.

It will be understood that the compressor and expander of a heat engine according to the invention may be of a still different type such as a rotating piston type. Besides, the compressor and expander which are used in combination are not necessarily of the same type but may be of the different types.

In a heat engine according to the invention, the power and speed of the engine can be controlled by regulating the quantity of heat supplied from the external heat source to the heater 70 and/or the quantity of the working gas confined in the engine.

In FIG. 8, the heat engine of FIG. 2 is provided with a power control or pressure regulation apparatus. The control apparatus comprises a gas reservoir 90, a gas feed passage 91 which connects the gas reservoir 90 to the passage 40 at a section between the cooler 50 and the compressor 20, and a gas discharge passage 93 connecting the reservoir 90 to the passage 60 at a section between the heater 70 and the compressor 20. A valve 92 is arranged to selectively provide and interrupt the fluid communication through the feed passage 91, and another valve 94 governs the fluid communication through the discharge passage 93. The reservoir 90 contains therein the working gas at a pressure between the maximum and minimum gas pressures in the engine.

The power produced by the engine can be augmented by opening the feed valve 92. Since the working gas in the passage 40 is in a low temperature low pressure state at a section between the cooler 50 and the compressor 20, the working gas is supplied from the reservoir 90 to the engine while the feed valve 92 is open. On the contrary, the power can be lessened by opening the discharge valve 94 so that a portion of the compressed working gas may be discharged from the passage 60 to the reservoir 90. The temperature profile of the working gas in the engine varies when either the feed valve 92 or the discharge valve 94 is opened. It is preferable, therefore, to simultaneously regulate the quantity of heat externally supplied to the heater 70. If the engine runs on an external combustion, for example, the quantity of the external heat can be regulated by regulating the feed rate of a fuel to a combustor.

FIG. 9 shows a modification of the control apparatus of FIG. 8 for the purpose of accomplishing the control of the engine power in a shorter period of time. In this case, the control apparatus has two gas reservoirs, a high pressure reservoir 90A and a low pressure reservoir 90B. The feed passage 91 connects the high pressure reservoir 90A to the passage 40 at a section between the cooler 50 and the compressor 20, and the discharge passage 93 connects the low pressure reservoir 90B to the passage 60 at a section between the heater 70 and the compressor 20. The feed valve 92 and the discharge valve 94 are arranged in the same manner as in the case of FIG. 8. The control apparatus includes an ordinary compressor 95 arranged to maintain the gas pressure in the high pressure reservoir 90A at a sufficiently high level even when the feed valve 92 is opened. The compressor 95 can extract a certain volume of the working gas from the low pressure reservoir 90B and pass the extracted gas to the high pressure reservoir 90A in a pressurized state.

The engine power can be controlled by opening either the feed valve 92 or the discharge valve 94 as described with reference to FIG. 8. If the working gas is air, the discharge passage 93 may be rendered communicable with the atmosphere by omitting the low pressure reservoir 90B.

The pressure-volume or indication diagram of FIG. 10 is presented for illustrating a change in the engine power by means of the control apparatus of FIG. 8 or FIG. 9. The diagram ABCEFAJA indicates a cycle of the operation of the engine with a certain work and is idealized by omitting the pressure drops CD and HJ in FIG. 4. The work done by the engine is indicated by the area ABEF. When the quantity of the working gas in the engine is increased by opening the feed valve 92 to increase the gas pressure $P_1$ in the heater 70 and the gas pressure $P_2$ in the cooler 50 to $P_1'$ and $P_2'$, respectively, accompanied with no change in the temperature profile of the working gas in the engine, the same cycle is indicated by the diagram A'B'C'E'F'A'J'A'. As the result, the area ABEF is enlarged to the area A'B'E'F'. The area ratio, (A'B'E'F')/(ABEF) is equal to the pressure ratio, $P_1'/P_1$ or $P_2'/P_2$. This pressure ratio is equal to the ratio of the mass of the working gas in the engine after the feed from the control apparatus to the same mass before the feed.

A heat engine according to the invention has the following advantages. (*a*) Since the engine runs on external heat, almost any fuel can be used when the engine takes the form of a combustion engine. Besides, heat in variously different forms exemplified by waste heat from a furnace and heat reserved in a regenerator can also be utilized. (*b*) In the case of an external combustion engine, the combustor is allowed to have a simple construction since the combustion can be carried out continuously at a low pressure near the atmospheric pressure. Besides, the feed of air and fuel to the combustor and the air/fuel ratio can be controlled quite easily. (*c*) In the case of a comubstion engine, it is very easy to prevent the exhaust gas from contributing to the atmospheric pollution. (*d*) The engine runs very quietly even in the case of a combustion engine since the combustion is continuous and does not produce a loud explosion.

These advantages are not characteristic of a heat engine according to the invention but are common to external heat engines. However, the essential feature of the invention, i.e., the provision of the two independent passages 40 and 60 for respectively cooling the expanded working gas and heating the compressed working gas, additionally brings about the following great advantages. (*e*) A high temperature part and a low temperature part of the engine can be constructed separately and isolated from one another, so that the engine scarcely suffers heat loss from the conduction of heat between the two parts. (*f*) Since the working gas makes a one way movement in the engine, the working gas has no chance of encountering a counterflow and stagnating. Accordingly the engine cycle proceeds at an improved thermal efficiency. (*g*) It is possible to provide intake and discharge valves to the passage connecting the compressor to the heater thereby to assure the realization of an intended engine cycle. (*h*) The engine power can be controlled by controlling the mass of the working gas confined in the engine, i.e., a means gas pressure in the engine, while temperature at various parts of the engine, particularly the maximum and minimum temperatures in the engine cycle, are maintained nearly constant. Accordingly the thermal efficiency of the engine can be maintained with little fluctuation at a high level even when the engine is operated under a fluctuating load. (*i*) Due to the possibility of controlling the engine power in such a manner, the engine can be constructed comparatively small both in size and in weight for producing a given power.

What is claimed is:

1. An external heat engine comprising:

a gas compression apparatus having a movable member arranged to define a variable volumn compression space;

a gas expansion apparatus having a movable member arranged to define a variable volumn expansion space said compression space and said expansion space having the same volumn when respectively maximized;

a driving mechanism arranged to be driven by the movement of said movable member of said expansion apparatus and drive said movable member of said compression apparatus the volumn of said compression space and volumn of said expansion space are simultaneously increased and simultaneously decreased;

a first fluid passage connecting said compression space to said expansion space;

a first heat exchanger arranged to transfer heat from an external heat source to a working gas confined in the engine at a section of said first passage;

a second fluid passage connecting said expansion space to said compression space independently of said first passage;

a first intake valve governing the communication of said compression space with said second passage;

a first discharge valve governing the communication of said compression space with said first passage;

a second intake valve governing the communication of said expansion space with said first passage;

a second discharge valve governing the communication of said expansion space with said second passage;

and a second heat exchanger arranged to absorbe heat from said working gas to a section of said second passage;

said first and said second passages being arranged in conjunction with said first and second intake valves and said first and second discharge valves functioning so that the engine operates according to the following cycle:

(a) compression of working gas confined in said compression space with simultaneous discharge of working gas from said expansion space into said second passage;

(b) discharge of the compressed working gas from said compression space into said first passage with continued decrease in the volume of said compression space;

(c) admission of the compressed and heated working gas from said first passage into said expansion space following the closure of said first passage to said compression space at the end of the decrease in the volumes of said compression and expansion spaces;

(d) expansion of working gas confined in said expansion space with simultaneous admission of cooled working gas from said second passage into said compression space; and (e) establishment of communication between said expansion space and said second passage simultaneously with the closure of said second passage to said compression space at the end of the increase in the volumes of said compression and expansion spaces.

2. An external heat engine as claimed in claim 1, wherein said movable member of said compression apparatus is a reciprocating piston received in a cylinder, said movable member of said expansion apparatus being a reciprocating piston received in a cylinder, said driving mechanism including a crankshaft and connecting rods respectively connecting said piston of said compression apparatus and said piston of said expansion apparatus to said crankshaft.

3. An external heat engine as claimed in claim 1, comprising at least two sets of a combination of said compression apparatus and said expansion apparatus, said first passage being arranged to connect the compression space of each compression apparatus only to the expansion space of a definite expansion apparatus which is in combination with said each compression apparatus through said first heat exchanger, said second passage being arranged to connect the expansion space of each expansion apparatus only to the compression space of a definite compression apparatus which is in combination with said each expansion apparatus through said second heat exchanger.

4. An external heat engine as claimed in claim 1, further comprising an engine power control apparatus including a gas reservoir containing therein said working gas at a pressure higher than the pressure of said working gas in said second passage but lower than the maximum pressure of said working gas in said first passage, a gas feed passage connecting said gas reservoir to said second passage at a section between said compression space and said second heat exchanger, a gas discharge passage connecting said reservoir to said first passage at a section between said compression space and said first heat exchanger, a feed valve arranged to selectively establish and interrupt fluid communication through said feed passage and a discharge valve arranged to selectively establish and interrupt fluid communication through said discharge passage.

5. An external heat engine as claimed in claim 1, further comprising an engine power control apparatus including a high pressure gas reservoir containing therein said working gas at a pressure higher than the maximum pressure of said working gas in said first passage, a gas feed passage connecting said high pressure gas reservoir to said second passage at a section between said compression space and said second heat exchanger, a feed valve arranged to selectively establish and interrupt fluid communication through said feed passage, a low pressure gas reservoir containing therein said working gas at a pressure lower than the minimum pressure of said working gas in said first passage, a discharge passage connecting said low pressure gas reservoir to said first passage at a section between said compression space said first heat exchanger, and a discharge valve arranged to selectively establish and interrupt fluid communication through said discharge passage.

6. An external heat engine as claimed in claim 5, wherein said low pressure gas reservoir is the atmosphere.

7. An external heat engine as claimed in claim 5, wherein said engine power control apparatus further includes a compressor arranged to extract a portion of said working gas from said low pressure gas reservoir and passing the extracted working gas to said high pressure gas reservoir in a pressurized state.

8. A method of controlling the power produced by an external heat engine, the engine including a gas compression apparatus having a movable member arranged to define a variable volume compression space, a gas expansion apparatus having a movable member arranged to define a variable volume expansion space, a driving mechanism arranged to be driven by the movement of said movable member of said expansion apparatus and drive said movable members of said compression apparatus, a first passage connecting said compression space to said expansion space, a first heat exchanger arranged to transfer heat from an external heat source to a working gas confined in the engine at a section of said first passage, a second passage connecting said expansion space to said compression space independently of said first passage, a second heat exchanger arranged to absorb heat from said working gas at a section of said second passage, said first and second passages being arranged such that said working gas is passed from said compression space to said expansion space only through said first passage and is returned to said compression space only through said second passage, the method comprising the steps of:

supplying said working gas from an external source of said working gas to the engine at least through said second passage at a section thereof where said working gas is at a relatively low temperature when augmentation of the engine power is intended thereby to increase the mass of said working gas confined in the engine;

extracting a portion of said working gas confined in the engine through said first passage at a section thereof where said working gas is at a relatively low temperature when lessening of the engine power is intended; and increasing the quantity of heat transferred from said external heat source to said working gas confined in the engine when said working gas is externally supplied to the engine but decreasing said quantity of heat when said portion of said working gas is extracted from the engine thereby to prevent changes in temperatures in the engine due to a change in the mass of said working gas confined in the engine.

* * * * *